US006123321A

United States Patent [19]

Miller

[11] Patent Number: 6,123,321

[45] Date of Patent: Sep. 26, 2000

[54] MODULAR RESILIENT CHILD OR PET SAFETY FENCE SYSTEM

[76] Inventor: David Miller, P.O. Box 2118, Boulder, Colo. 80306

[21] Appl. No.: 09/022,562

[22] Filed: Feb. 12, 1998

[51] Int. Cl.[7] ..... E04H 17/16

[52] U.S. Cl. ..... 256/25; 256/26; 256/31; 160/135

[58] Field of Search ..... 256/24, 25, 26, 256/27, 31, 73; 160/135

[56] References Cited

U.S. PATENT DOCUMENTS

| | | | |
|---|---|---|---|
| 4,129,163 | 12/1978 | Johnson . | |
| 4,208,037 | 6/1980 | Le Gai . | |
| 4,221,086 | 9/1980 | Berman | 160/135 |
| 4,538,309 | 9/1985 | Gunter . | |
| 4,635,418 | 1/1987 | Hobgood . | |
| 4,685,247 | 8/1987 | Alam . | |
| 4,712,773 | 12/1987 | Larson | 256/26 |
| 4,831,777 | 5/1989 | Johnson, Jr. . | |
| 4,883,267 | 11/1989 | Burley | 256/24 |
| 4,927,134 | 5/1990 | Burley | 256/24 |
| 4,944,117 | 7/1990 | Gebhard . | |
| 5,007,473 | 4/1991 | Evensen . | |
| 5,029,819 | 7/1991 | Kane | 256/32 |
| 5,076,545 | 12/1991 | Bodzin | 256/24 |
| 5,356,119 | 10/1994 | Schock | 160/135 |
| 5,367,725 | 11/1994 | Tsai . | |
| 5,437,134 | 8/1995 | Donnelly . | |

FOREIGN PATENT DOCUMENTS

| | | | |
|---|---|---|---|
| 426151 | 1/1934 | United Kingdom | 160/135 |

OTHER PUBLICATIONS

Child Safe Pool Fence Company, product information http://www.childsafepoolfence.com.

Protect–A–Child Pool Fencing, product information http://www.protectachild.com/fence.htm.

*Primary Examiner*—Lynne H. Browne
*Assistant Examiner*—David E. Bochna
*Attorney, Agent, or Firm*—Kyle W. Rost

[57] ABSTRACT

A modular fence unit provides a rigid frame supporting flexible and resilient sheet plastic that is stretched over and secured to the frame to create a visually open, yet resilient barrier. Each modular unit is provided with a connector for joining together one or more juxtaposed modular units or for attachment to an available stationary fixture such as a wall. The connectors may permit junctions between units in freely selectable angled relationships. Connections may be hinged, while others may provide a releasable latch, allowing a modular unit to serve as an access gate.

6 Claims, 11 Drawing Sheets

MODULAR RESILIENT CHILD OR PET SAFETY FENCE SYSTEM

BACKGROUND OF THE INVENTION

This invention relates to a system for restraining children or household pets. The objective of such restraint is typically either to confine the subject to a secure area, or in the alternative to prevent the subject from entering a hazardous area. This invention discloses a restraining system comprising a modular and resilient fence.

BRIEF DESCRIPTION OF THE PRIOR ART

Among the most common devices in use today for restraining children in particular areas is the ubiquitous playpen. The typical playpen, which may or may not be portable and/or collapsible, comprises a frame in the form of a right, square or rectangular parallelopiped, with square or rectangular edges approximately three to five feet in length and approximately two and one-half feet in height. The frame composition may be dowel, tubing or rod comprised of wood, plastic, or metal. Spanning the frame at side faces and perhaps at the bottom face of the playpen is some planar element secured to the frame to form a barrier, while the top face of a typical playpen is open. The bottom face of a playpen, if it is not open, typically is comprised of cloth, flexible sheet plastic or rubberized material. The side faces of a typical playpen are comprised of some form of grid, bars or mesh, providing security with some degree of visibility.

A child is placed in and removed from a typical playpen by an adult's lifting the subject child over the side of the playpen. Such playpens provide no other means of ingress and egress from the child enclosure. Because of this manner of ingress and egress for typical playpens, the height of the sides of such playpens is limited to that which is comfortable for adults who must lift the subject child over the playpen's sides. Such limited height may not be sufficient to discourage the scaling of the playpen by older subject children.

Typical playpen designs along the foregoing lines are illustrated in the following U.S. Pat. No. 4,208,037 to Le Gal; U.S. Pat. No. 4,538,309 to Gunter; and U.S. Pat. No. 5,367,725 to Tsai.

Another common device for restraining children to or from a particular area is the child safety gate. Most often used as a barrier at a threshold such as a doorway or the top or bottom of a stairway, the child safety gate at its simplest is a gate structure spanning the width of the doorway or the stairway. Typically, the gate structure comprises a frame element of lesser or greater complexity, with a planar element spanning the frame and secured thereto to form a barrier. As in the typical playpen design, for a security gate the frame element may be dowel, tubing or rod comprised of wood, plastic, or metal, and, as in the side elements in a typical playpen, the planar element of the safety gate may be comprised of some form of grid, bars or mesh for partial visibility, or in the alternative the planar element for a safety gate may comprise molded or formed plastic. The safety gate is securely engaged to the stationary surfaces of the doorway or stairway to present a barrier to the passage of the child through the doorway or stairway. The safety gate also is often designed to engage swingably, foldably or sidably in the doorway or stairway, permitting an adult to swing, fold or slide the gate into an open position when security is not needed. Typical child safety gates are illustrated in the following U.S. Pat. No. 4,944,117 to Gebhard; U.S. Pat. No. 4,685,247 to Alam; U.S. Pat. No. 5,437,134 to Donnelly; and U.S. Pat. No. 4,831,777 to Johnson, Jr.

Another related area of art is that of pool safety enclosures. Typical of such fences is the pool fencing of Protect A Child® Fence Company, comprising a mesh supported by vertical support posts fabricated of aluminum or composite fiberglass. The Protect A Child® fence is installed by drilling holes in the patio area surrounding the pool and inserting polyvinyl sleeves for receiving the vertical support posts. Differing somewhat in the installation and composition of its vertical supports, the Child Safe Pool Fence Company supports its mesh with a frame of Poly-Vinyl Chloride, affixed to already existing supports such as posts, walls or pillars. If additional support is needed, Child Safe supplies specially designed planters that attach to the inside of the fence and serve as support for the PVC frames. In pool fencing applications, it is preferable to have higher fencing; in many jurisdictions, such as Florida, 48 inch height is the minimum requirement for pool fencing.

A disadvantageous characteristic in common to prior art playpens, prior art safety gates and prior art pool enclosures is that each is limited or fixed as to the area that it secures: depending upon its fixed dimensions, a playpen secures a fixed area of six to twelve square feet or so. A safety gate secures an area on one side of a threshold from the area on the other side of the threshold. The configuration of a pool safety fence is fixed because the typical posts or uprights used in that application are fixed in place.

A related area of art is that concerning privacy screens and room divider partition systems. U.S. Pat. Nos. 4,129,163; 4,635,418; and 5,007,473 teach such systems and are perhaps representative of this area of art. In such screens and room dividers, panels, typically comprising a frame with a planar barrier, are interconnected to partition one area of a room from another. Such systems, as disclosed in '473 in column 3, line 2, generally contemplate that the planar barrier be of a relatively stiff material. Many such systems allow interconnection of an arbitrary number of panels, as determined by the user according to his or her partitioning needs. In many such systems also, the user can adjust the interconnection of panels to any selected relative angular position, allowing the user to configure the partitioned area.

While some privacy screens and room divider partition systems may overcome the limitation on configurability suffered by most playpens and safety gates, if used for child restraint purposes they have other limitations in common with prior art child restraining systems.

A disadvantageous characteristic of the prior or related art pertains to the material of which the planar barrier element is comprised: the barrier may be so obdurate as to present the risk of contusion to an infant, as in the case of barriers of metal or wooden bars or molded or formed plastic; even when in the form of resilient material such as netting or mesh, the barrier may be so unyielding as to present the risk of abrasion of delicate infant skin.

Another disadvantageous characteristic shared by playpens, safety gates, pool fencing and screening systems is that they have a visual impact in the area in which they are employed that is significant and, if not negative, then certainly intrusive.

Another disadvantageous aspect of the related art is that no single system of restraint may be employed to restrain a subject in a designated area, as does a playpen, to prevent access and egress of a subject through a threshold, as does the typical safety gate, and also to demark and isolate a potential danger, as does a pool fence.

It is an object of this invention to overcome or ameliorate at least some of the foregoing limitations and disadvantages of the prior art.

SUMMARY OF THE INVENTION

The invention at its simplest comprises modular sections of fencing presenting a resilient barrier, which sections may be connected by connecting means in a configuration determined by the user to form, if in a closed figure, a free standing, stable child enclosure. In the alternative, the user may connect modules of the invention to form an open figure, again in a user-determined configuration, which figure may then be secured at each end to stationary structures such as walls, doorways and the like by means well known in the art to form a stable child enclosure. In this manner, the area secured by the use of this invention is not fixed but rather is configurable according to the wishes and needs of the user. Hinged connecting means on at least one modular section in preferred embodiments in this application permits easy ingress and egress for placement and removal of the subject from the enclosure.

At least one modular section of this invention may also be connected to a stationary surface to span a doorway or the entry of a stairway, as an alternative to a conventional safety gate. Such use is further enhanced in preferred embodiments by at least one hinged connecting means permitting a modular section in such application to swing as a conventional safety gate.

With appropriate means for securing sections to areas adjacent to a pool, this invention may also serve as an alternative to conventional pool safety fencing, again enhanced in preferred embodiments by at least one hinged connecting means permitting a modular section to swing as a gate.

BRIEF DESCRIPTION OF THE DRAWINGS

The invention is further described in connection with the accompanying drawings, in which.

DESCRIPTION OF THE PREFERRED EMBODIMENTS

Figure 2:
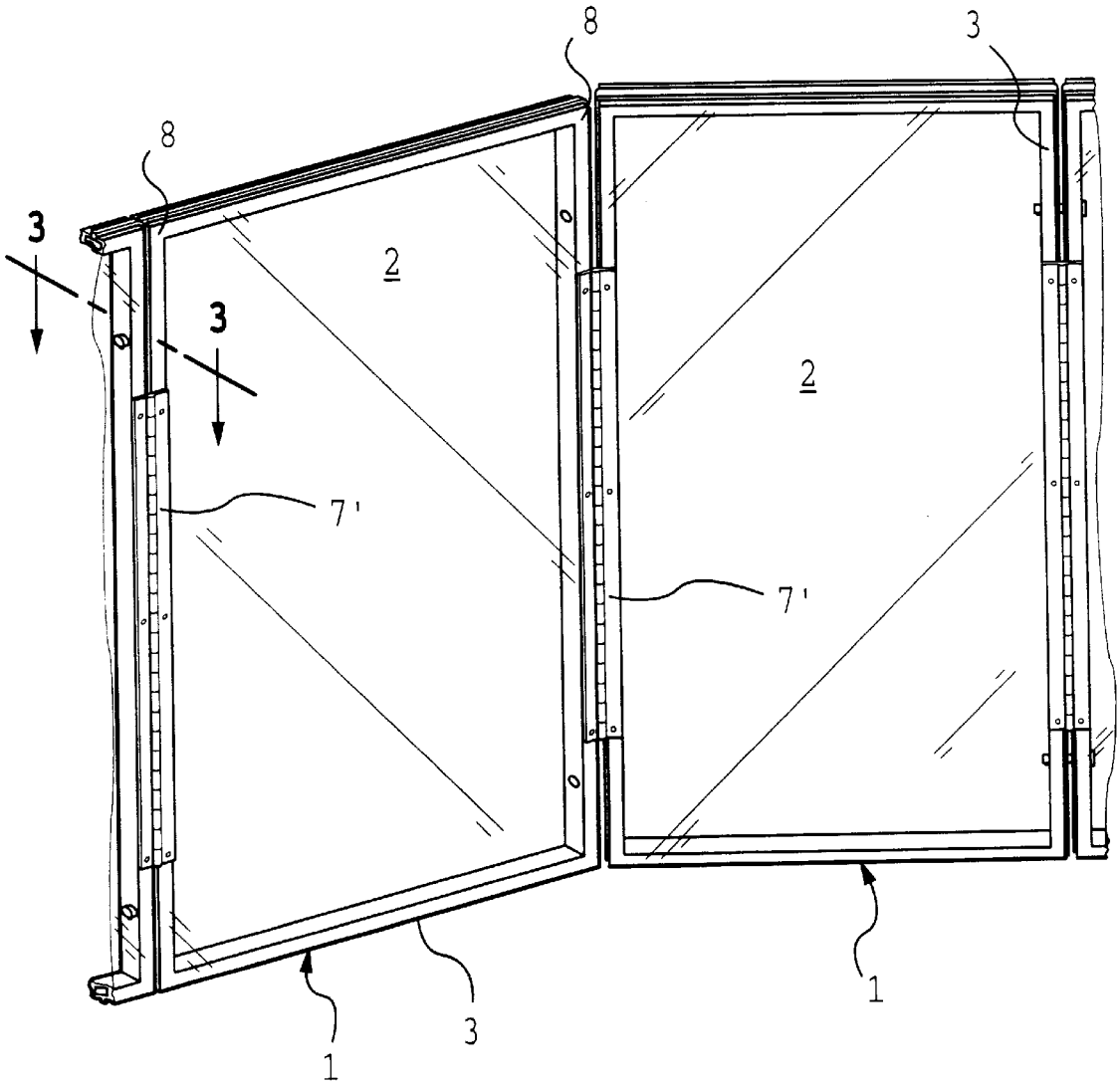
FIG. 2 is a perspective view of a portion of a typical application of several modular panels connected by connecting means, in this embodiment piano hinges.
Figure 5:
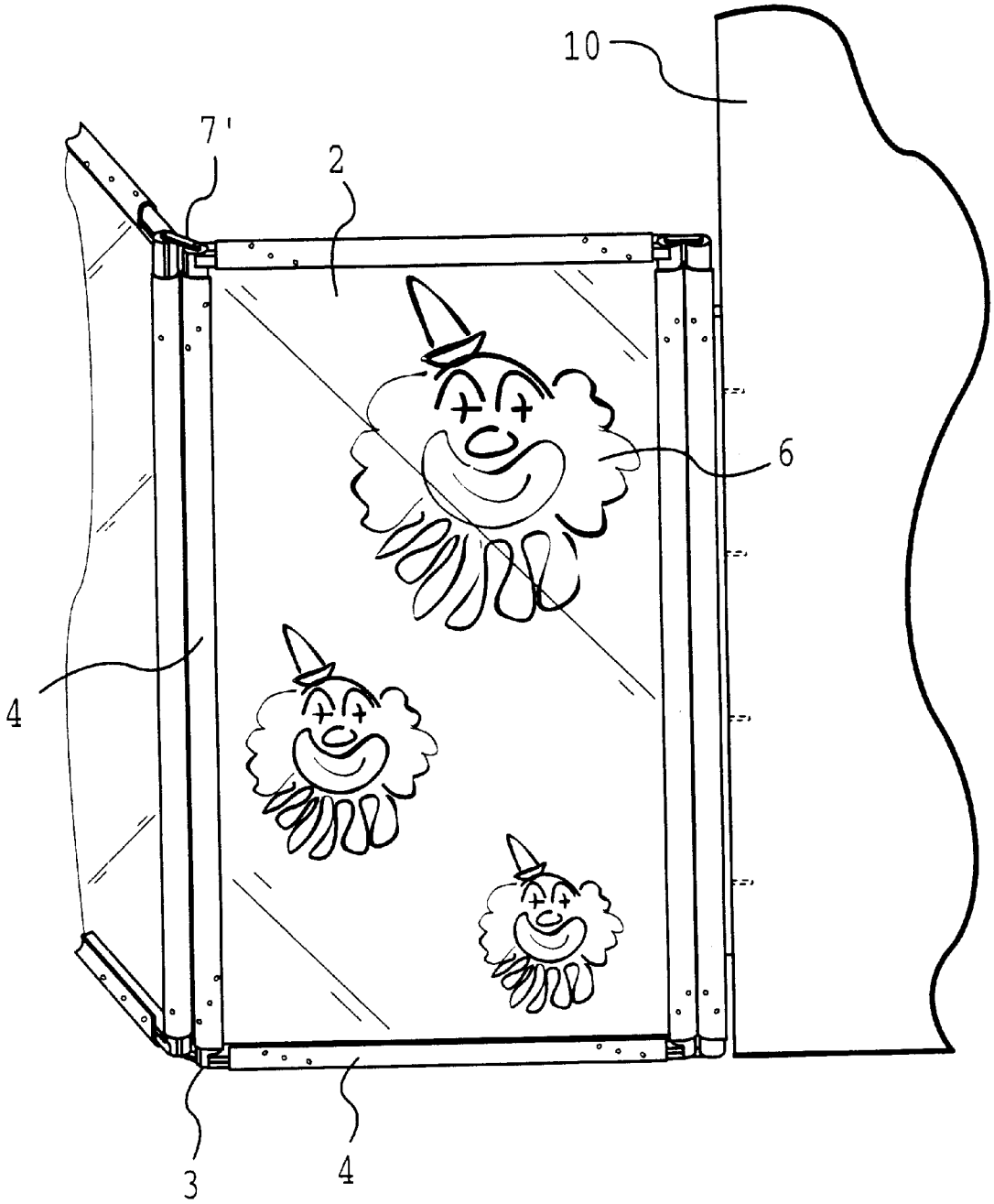
FIG. 5 is a perspective view of a portion of an application with the planar barrier of at least one of the modules displaying a decorative design, connected on one side to another module and on the opposite side to a stationary surface, with foam padding on the tube of the frame.

Referring now to the drawings in more detail, in FIG. 2 a modular section 1 of this invention comprises a planar barrier element 2 composed of strong but resilient sheet plastic, such as calendared or extruded polyethylene or polyvinyl chloride sheeting, which barrier is then affixed by some affixing means (as depicted in, for example, FIG. 3) to a strong and rigid or semi-rigid frame 3 of a material and type of construction well known in this or related arts. Such frame 3 may be constructed of rigid plastic, hardened rubber, wood or metal. It is preferred that such frame 3 also be lightweight and therefore lighter weight materials, among them aluminum, are preferred for the frame 3. It is also preferred that the fence 1 itself present a soft or resilient surface to the subject child or pet, to minimize the risk of contusions or abrasions to the subject. Therefore, it is preferred that such frame 3 have a means for padding, as in, for example the padding 4 shown in FIG. 5, to prevent contact between the subject and any hard frame surfaces.

In preferred embodiments of the invention, the frame 3 of the modular section 1 is square or rectangular in shape, to be oriented in an enclosure application so that the sides of the square or rectangle are disposed roughly horizontally and vertically. It is preferred that the modular section 1 be dimensioned so that, in an enclosure application, the height of the module 1 is sufficiently great that the subject (a child or a pet) cannot easily scale the module 1. In preferred embodiments for child enclosures, the height of the enclosure 5 should be at least 36 inches, but more preferably approximately 42 inches. In preferred embodiments for pool enclosures, the height of the enclosure 5 should be at least 48 inches.

Because modules 1 may be fabricated in a rectangular shape, with rectilinear sides of substantially different length, such embodiment facilitates a construction of two enclosure systems 5 of substantially different heights from a single set of modules 1. In a first such system 5, the modules 1 are disposed with their longer sides along the floor surface. In such first system, the height of the enclosure 5 formed by the modules 1 is substantially lower than a second such system, in which the modules 1 are disposed with their shorter sides along the ground. Such user-selectable height of the enclosure 5 may confer advantages to such embodiments over the prior art, which does not permit user-selection of the height of an enclosure.

Figure 1:
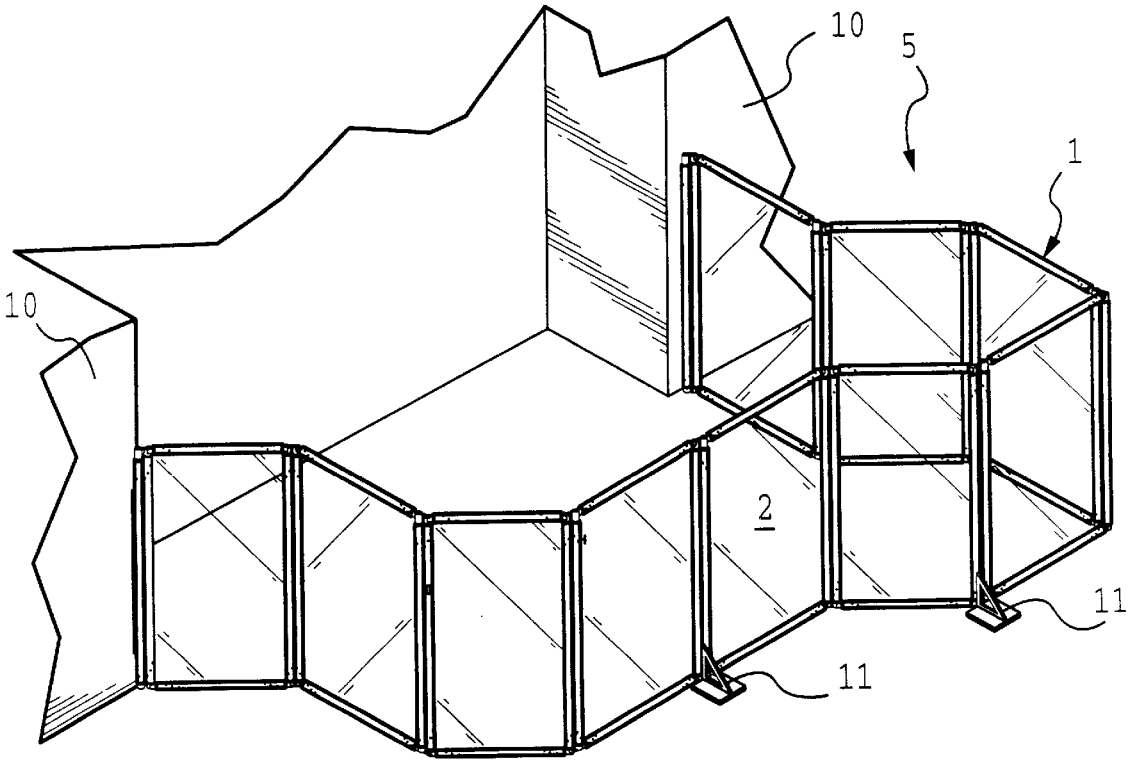
FIG. 1 is a perspective view of a typical application of the system, here showing an open configuration connected at each end to stationary surfaces of a wall by connecting means.

The resilient sheet material 2 affords considerable safety to an infant encountering the barrier. It should be noted that preferred embodiments of this invention utilize sheet plastic especially selected for non-toxicity and suitability for use in infant and child environments. In some embodiments of this invention, the sheet plastic comprising the planar barrier element 2 is substantially transparent or translucent (FIGS. 1, 15), lowering the visual impact of the invention and allowing observation of the subject child or pet when used as set forth above. In other embodiments of this invention, the sheet plastic element 2 is polished, colored, textured or decorated, as in FIG. 5, with decals or other designs 6 to provide an ornamental aspect to the barrier element.

Figure 3:
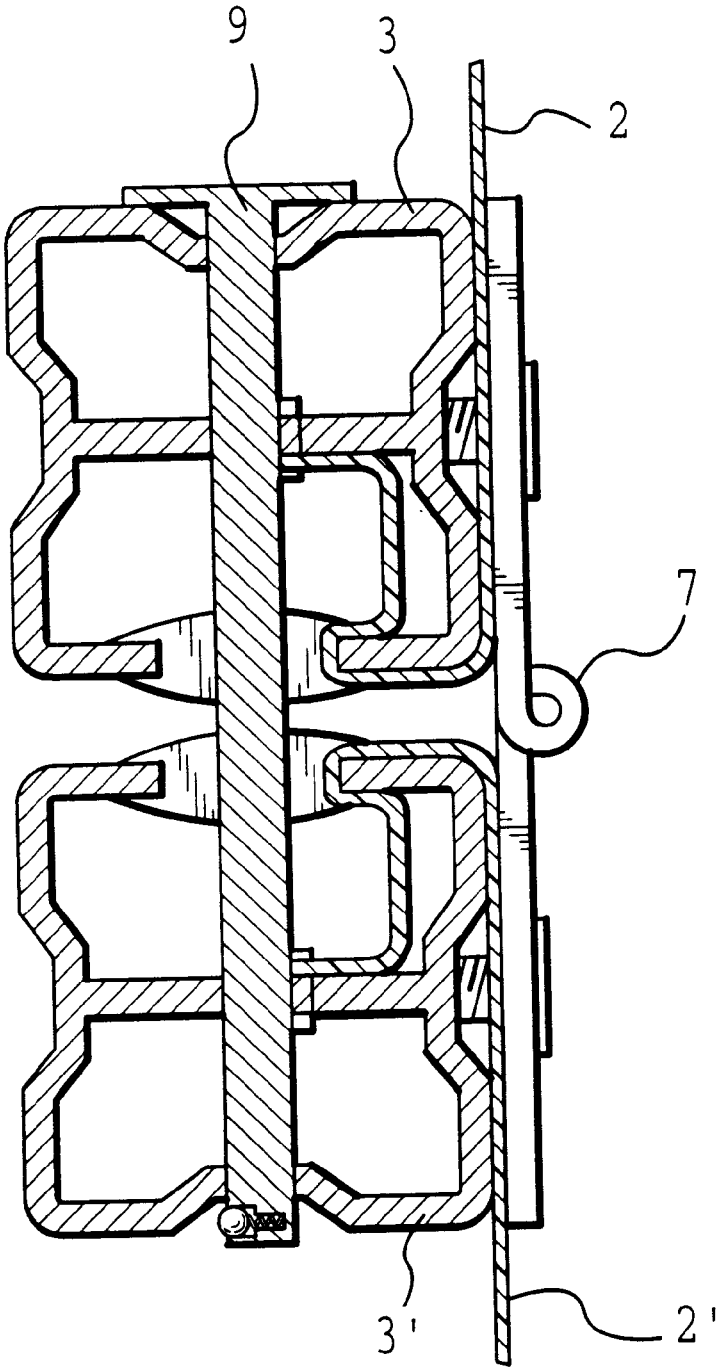
FIG. 3 is a cross-sectional view, taken along line 3—3 of FIG. 2, of one embodiment showing a means for connecting two panels at their frames, a means for affixing the resilient sheet material to the frame elements, and a means for the user to lock the hinge of the connected modular panels at a fixed angle, here 180 degrees.

The means of affixing the resilient plastic sheet material to the frame, as shown, for example, in FIG. 3, may comprise means well known in this or related arts, including stapling, crimping, bolting or bonding and various combinations thereof. Referring to FIG. 3, in this embodiment the means of affixing the plastic sheet material 2 to the frame 3 comprises a crimp-and-lock design of the frame 3 in a manner well known in the art of, for example, the manufacture of awnings.

Modular sections 1 of the invention are connected to each other or to a stationary surface by connecting means 7. In embodiments wherein the frames 3 of modular sections 1 are square or rectangular in shape, such connecting means 7 permits connecting a modular section 1 or a stationary surface 10 (referring to FIGS. 1, 5, 6 and 15), and to either or both vertical sides 8 of a given module 1. In view of the invention's intended purpose, it is preferable that the connecting means 7 be of sufficient strength to resist the pulling down or breaking apart of modules by a subject pet or child. It is also preferable that modules be connected so that a subject child or pet cannot pinch or catch extremities in interstices between the modules or between a module 1 and a stationary surface 10. Therefore, in preferred embodiments, connecting means 7 are such that no such interstice exceeding approximately ⅛ inch be presented to the subject.

Figure 6:
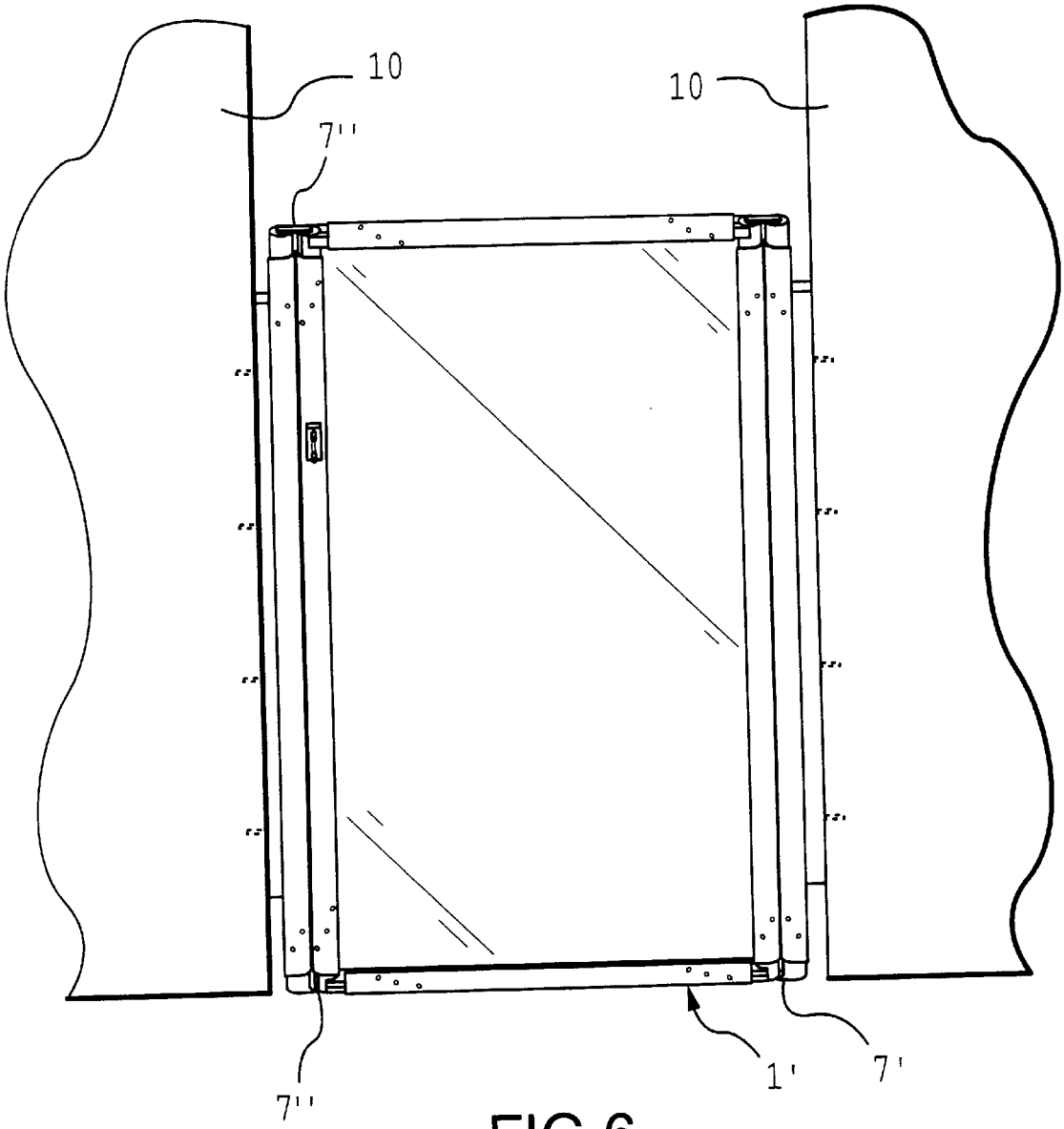
FIG. 6 is an elevation of a single panel spanning a doorway or entry to a stairway, connected to the stationary surfaces on opposite sides by connecting means.
Figure 15:
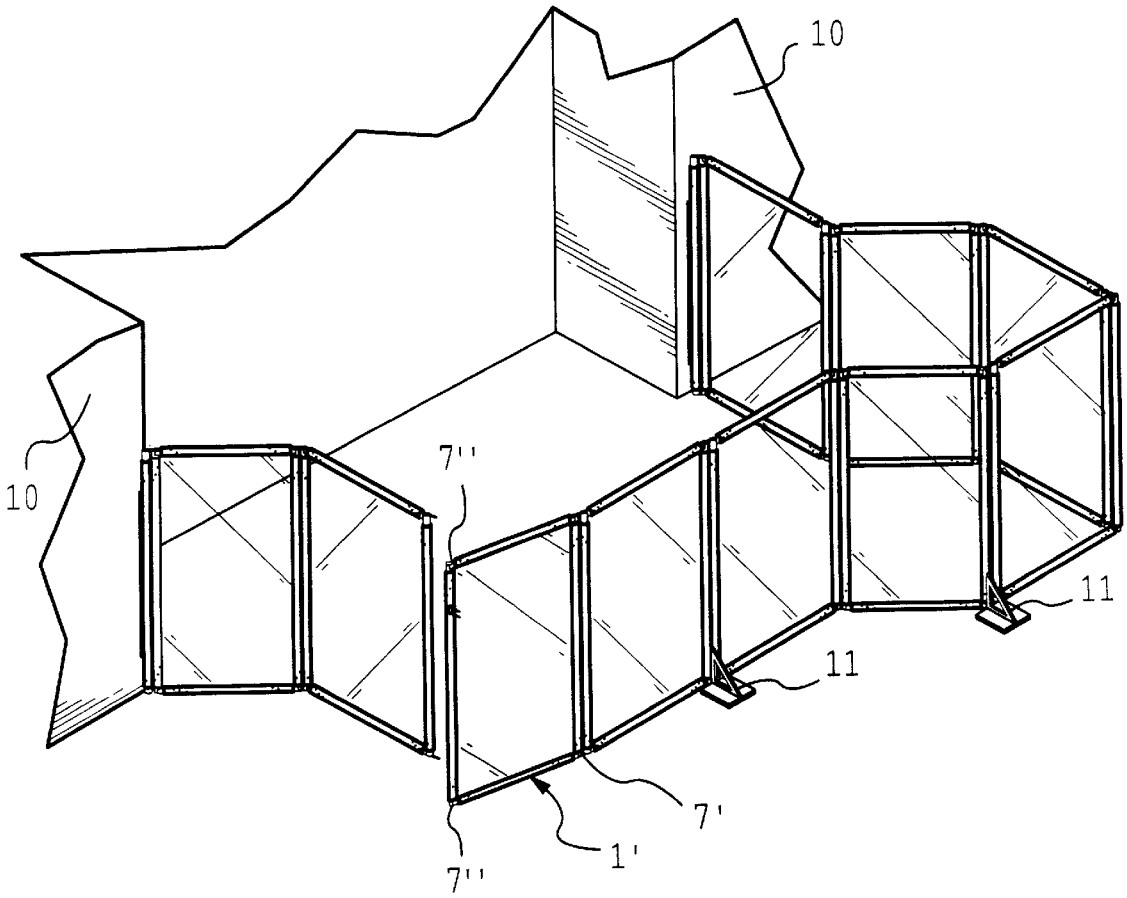
FIG. 15 is a perspective view of the same application of the system as illustrated in FIG. 1, but here showing a module with hinged connecting means swung open in the manner of a gate.

It is preferred that at least some connecting means 7' be hinged, permitting the module 1 to hinge with respect to the item (another module or a stationary surface) to which it is connected, as depicted in FIGS. 6 and 15. Such hinged connecting means 7' permits user configuration of the area enclosed by connected modules.

Figure 7:
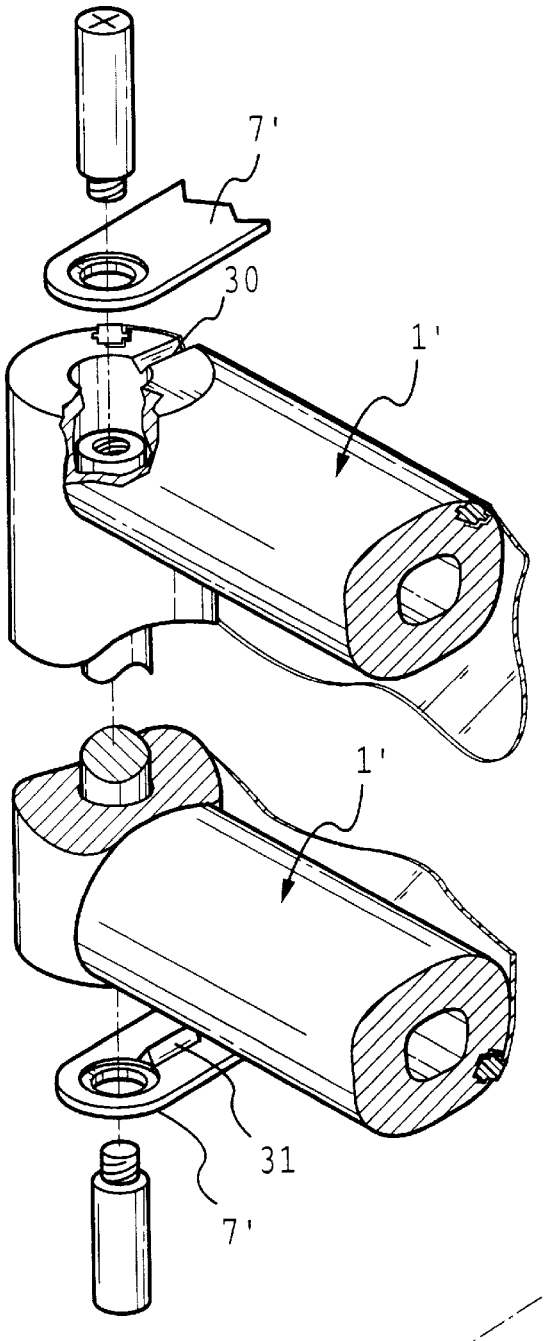
FIG. 7 is an exploded fragmentary perspective view of a portion of a panel's frame and a connecting means forming an embodiment of a hinged connecting means, additionally showing an embodiment of a means of resisting hinged movement of the panel from a particular open position.
Figure 7A:
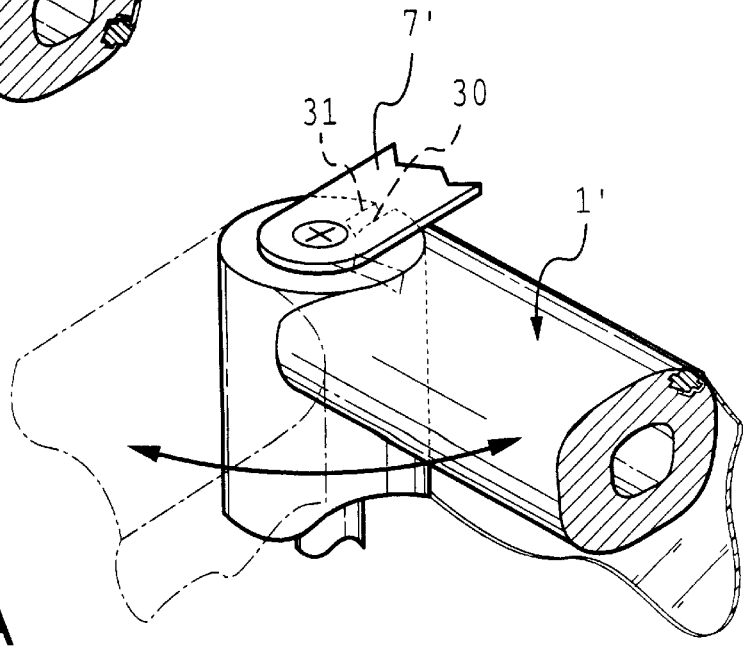
FIG. 7A is a detailed perspective view of one embodiment of a hinged connection with a modular panel, showing the direction of swing and open and closed positions of the modular panel, also showing means for resisting hinged movement of the panel from a particular open position.

When, as in FIGS. 6 and 15, a hinged module 1' is to serve as a gate, it may be preferable to have, when the hinged module is open, a means of resisting hinged movement of the open module from some desired open position, thus tending to keep the gate open and preventing unintended swinging of the gate from such position. The resistance provided by such resisting means, however, is preferably easily overcome, allowing opening and closing functionality in such module 1' serving as a gate. Such a resisting means is illustrated in FIGS. 7 and 7A, wherein slotted or toothed element 30 resistingly engages a corresponding element 31 in hinged connecting means 7' when the module 1' is opened to a certain angle.

Figure 4:
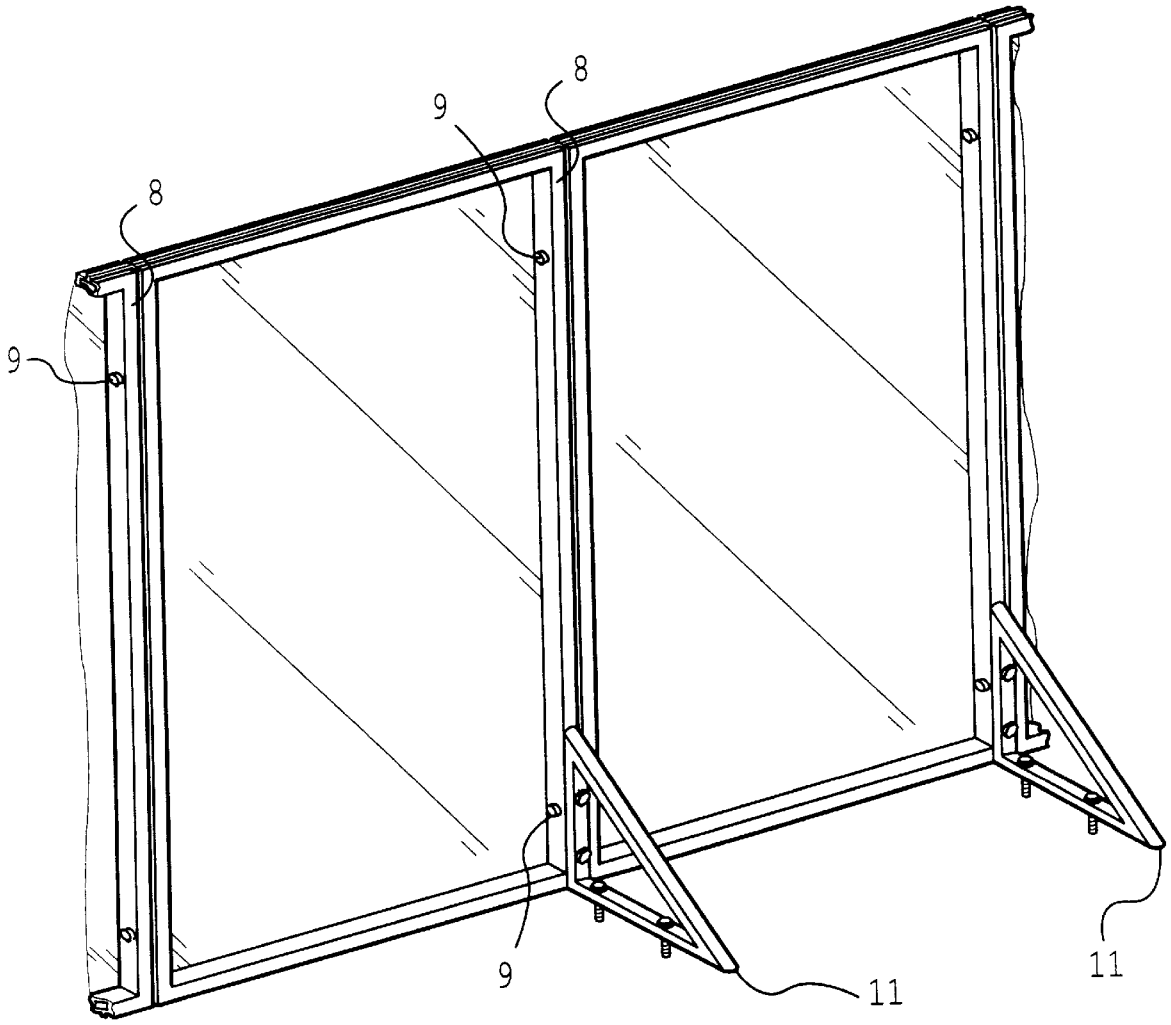
FIG. 4 is a perspective view of a portion of a typical application of modular panels with additional supporting braces attached to at least some of the panels.

Some embodiments of the invention employing hinged connecting means 7' further comprise a means 9, as depicted in FIGS. 3 and 4, for a user to lock the hinge 7' of the connected modular sections 1 at some predetermined angle convenient for certain enclosure configurations, perhaps 45, 90 or 180 degrees, which angle of locking may in some embodiments be user selectable. Such locking means 9 can afford greater structural integrity for an assembly of modular sections 1 forming an enclosure 5.

It is preferred that, for at least some modular sections 1' as in FIGS. 6 and 15, the connecting means 7" on at least one side of the section 1' be selectively releaseable. If the connecting means 7' on another side of such module 1' is hinged, such module 1' may selectively swing open and thereby serve as a gate to the enclosure 5, as depicted in FIG. 15, or as a gate between stationary surfaces 10 such as a doorway or the entrance to a stairway, as depicted in FIG. 6. Because ingress and egress is via such module 1' serving as a gate rather than from above by bending over the module, in such embodiments the height of the enclosure is not limited as it is for the typical playpen.

Means 7" of connecting a module 1' in a selectively releasable manner may be embodied in numerous ways. One such embodiment is illustrated in detail in FIGS. 8, 9 and 10. In such embodiment, two rods, a lower rod 12 and an upper rod 13, are disposed slideably end-proximal-to-end within a cylindrical chamber within a vertical side 8 of frame 3. Disposed between the proximal ends of the rods are levers 15 and 16, biased apart by a spring 17, so as, in a normally released position of the levers 15 and 16, to cause the distal end 19 of upper rod 13 to protrude significantly beyond the top of the vertical side 8 of frame 3, and the distal end 18 of the lower rod 12 to protrude slightly beyond the bottom of the vertical side 8 of frame 3. In such normal position, the protruding ends 18 and 19 may engage means 7" for connecting the module 1 to another module 1 or to a stationary surface 10. When the levers 15 and 16 are compressed together, the upper rod 13 and the lower rod 12 are retracted within the vertical side of frame 3, releasing the connecting means 7" and allowing the module 1' to swing open on the hingeable connecting means 7' on another side of module 1', as illustrated in FIG. 6.

In the embodiment of a releasable connecting means 7' illustrated in detail in FIGS. 8, 9 and 10, the normal position of the distal end 18 of the lower rod 12 is such that it just engages the lower connecting means 7" so that, when the module 1' is swung open as a gate, said distal end 18 does not protrude excessively below the bottom of the vertical side 8 of the frame 3, thus minimizing risk of damage to or catching upon the surface upon which the modular fence is disposed.

Figure 8:
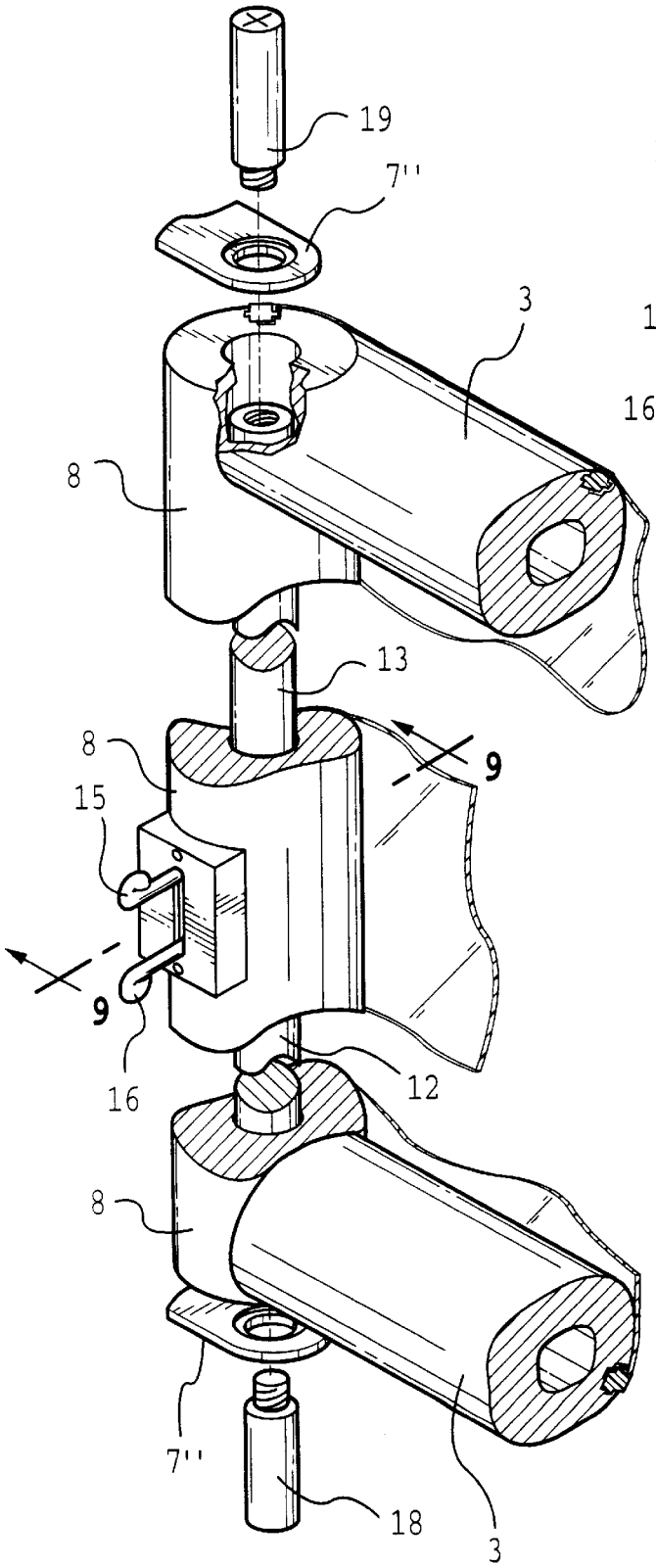
FIG. 8 is an exploded fragmentary perspective view of a portion of a panel's frame and related components forming an embodiment of a releaseable connecting means.
Figure 9:
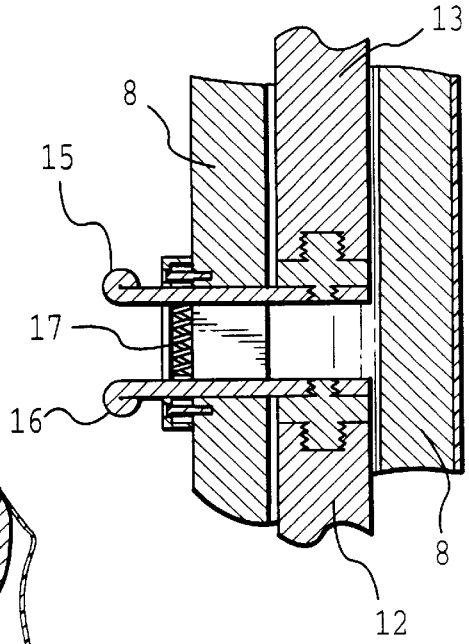
FIG. 9 is a cross-sectional view of a portion of the releaseable connecting means taken along line 9—9 of FIG. 8.
Figure 10:
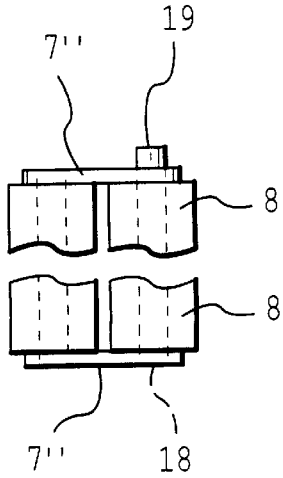
FIG. 10 is a fragmentary side view of the releaseable connecting means of FIG. 8.
Figure 11:
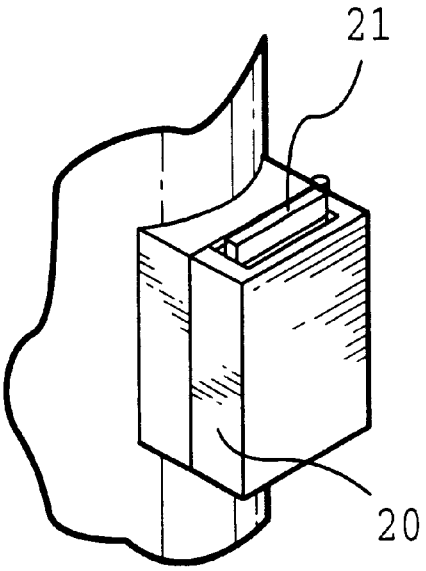
FIG. 11 is a perspective view of a portion of a releasable connecting means, with release mechanism enclosed in a hinged releasable security enclosure in a closed position.
Figure 12:
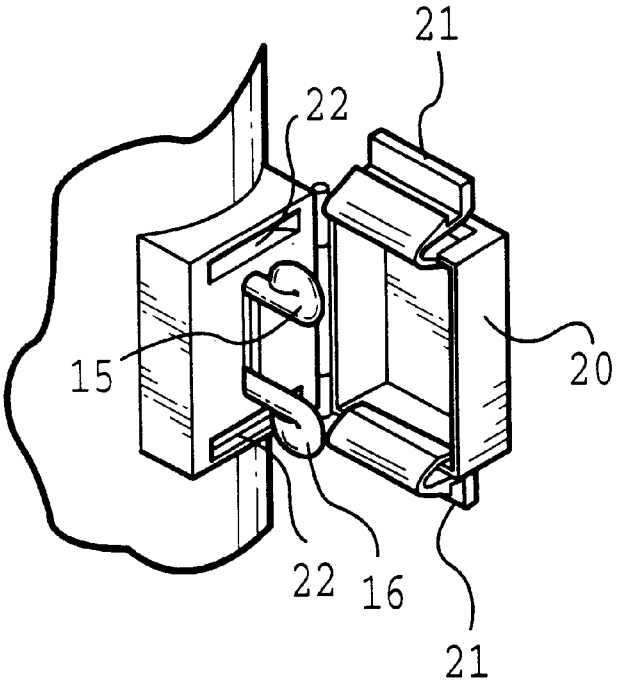
FIG. 12 is a perspective view of the same hinged releasable security enclosure as illustrated in FIG. 11, in this case in an open position.

For security purposes, the means of selectively releasing a releasable connecting means 7", such as levers 15 and 16 in FIGS. 8, 9 and 12, may be covered as in FIGS. 11 and 12, by locking hinged cover 20. The locking mechanism for such locking hinged cover 20 may employ any of many locking means well known in appropriate arts to be effectively "child-proof", as embodied in the deformable squeeze-flanged mechanism 21 in FIGS. 11 and 12, engaging slots 22 shown in FIG. 12.

In applications where modular sections 1' are connected to a stationary surface 10, such as a doorway or entrance to a stairway as illustrated in FIG. 6, the connecting means 7' and 7" for the module 1' each comprises a secure attachment to the stationary surface 10 which may be by means well known in appropriate arts.

In applications where modular sections 1 span greater distances, or in other applications where sections 1 may be under greater lateral stress, a module 1 may further comprise an additional brace means or support 11 affixed to a module's frame 3 to maintain the module 1 in an upright position.

Figure 13:
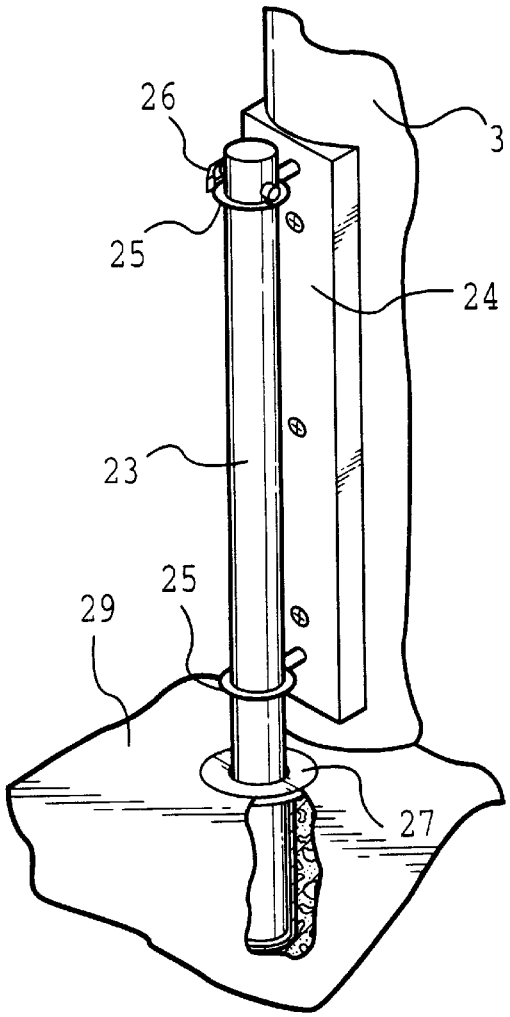
FIG. 13 is a cut-away perspective view of a means for securing the fence in a pool safety fence application.
Figure 14:
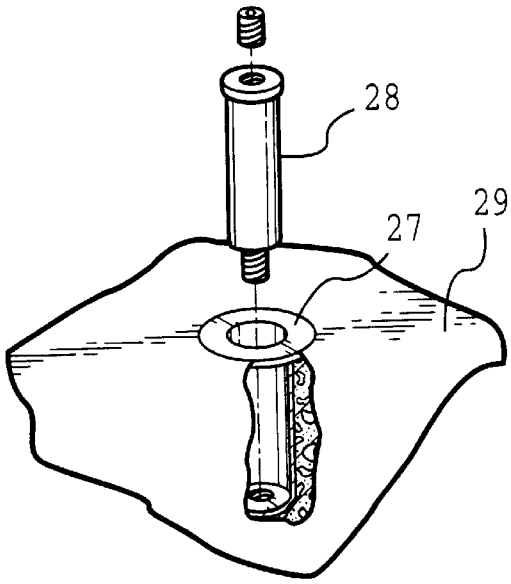
FIG. 14 is a cut-away and exploded perspective view of a means for sealing the pool safety fence securing means when it is not in use.

In certain applications, for example for pool security purposes, as illustrated in FIG. 13, a brace means for maintaining modules in an upright position may comprise a pole 23, affixed, perhaps removably in a receptacle 27, in the horizontal surface 29 surrounding the pool, which pole 23 engages the frame 3 of a module, for example by means of an attachment 24 securely connected to the frame 3 upon which are eyelets 25 which may be slid over the pole 23. A cotter pin 26 or equivalent means for resisting motion of an eyelet along the rod 23 may be inserted in the rod above an eyelet to resist removal of the module 1 once it is in the desired position and engaged with the pole 23. Because it may be desirable to remove the pole 23 when it is not needed to maintain modules in an upright position, it may be desirable to remove the pole 23 from the area, and so, as illustrated in FIG. 14, the invention may provide a receptacle 27 from which the pole may be removed, and into which, for safety and/or aesthetic purposes, a removable insert 28, may be placed to close off the receptacle 27 flush with the surface 29 of the pool.

While preferred embodiments of the invention have been shown and described, it will be apparent to those skilled in this art that various modifications may be made in these embodiments without departing from the spirit of the present invention. For that reason, the scope of the invention is set forth in the following claims:

I claim:

1. A modular resilient fence, in which at least one fence module comprises:

a rigid perimeter frame of predetermined length and width;

a resilient planar element secured to said frame along both its length and width, closing the frame, formed of substantially transparent, flexible sheet plastic held in tension across the frame, thereby establishing a rebound surface; and a connecting means suitable for joining the frame, in use, to a juxtaposed structure, to form a barrier to ingress and egress.

2. The modular resilient child or pet safety fence of claim 1, wherein said connecting means comprises a hinge allowing variable angular orientation of said one fence module, in use, with respect to a juxtaposed structure.

3. The modular resilient child or pet safety fence of claim 2, wherein said hinge is connected to the frame for allowing pivotal movement of said fence module near a first lateral edge thereof, and further comprising a selectively engageable and releasable latch at a second and opposite lateral edge of the fence module for allowing use of the fence module as a gate.

4. The modular resilient child or pet safety fence of claim 1, wherein said resilient planar element is formed from a material selected from the group consisting of colored, polished, textured and decorated sheet plastic, and combinations thereof.

5. The modular resilient child or pet safety fence of claim 1, wherein said resilient planar element is secured over a first face of said frame, and further comprising:

at least one brace means for maintaining the fence in an upright position, extending from a second surface of the frame, opposite from said first face.

6. A modular resilient child or pet safety fence, comprising:

at least first and second planar fence modules positionable such that each has a substantially vertical side edge, with said vertical side edge of each juxtaposed to the vertical side edge of the other module, wherein each of said fence modules is formed of a rigid, planar frame closed along both its length and width by resilient, clear, flexible sheet plastic held in tension across the frame and secured thereto, thereby establishing a rebound surface;

a connecting means for joining said first frame to said second frame at said juxtaposed vertical side edge of each and permitting variable angular orientation between the frames about said connecting means and thereby allowing formation of user selected fence configuration; and a means for padding a frame surface against external contact.

* * * * *